US006200058B1

(12) United States Patent
Maudal

(10) Patent No.: US 6,200,058 B1
(45) Date of Patent: Mar. 13, 2001

(54) SEGMENTED PAPER LIFTER WITH MULTIPLE AND VARIABLE LENGTH LEVER ARMS

(76) Inventor: Inge Maudal, 604 Lassen La., Costa Mesa, CA (US) 92626-3122

( * ) Notice: Subject to any disclaimer, the term of this patent is extended or adjusted under 35 U.S.C. 154(b) by 0 days.

(21) Appl. No.: 09/303,741

(22) Filed: May 3, 1999

(51) Int. Cl.[7] ..... B42F 13/00
(52) U.S. Cl. ..... 402/80 L
(58) Field of Search ..... 402/80 L, 80 R, 402/4, 79; 281/28, 38, 15.1, 21.1

(56) References Cited

U.S. PATENT DOCUMENTS

| | | | | |
|---|---|---|---|---|
| 1,894,241 | * | 1/1933 | Raynolds | 402/80 L |
| 3,366,118 | * | 1/1968 | Beyer | 402/80 L |
| 4,573,822 | * | 3/1986 | Allen | 402/80 L |
| 5,503,489 | * | 4/1996 | Mandal | 402/80 L |

* cited by examiner

*Primary Examiner*—Willmon Fridie, Jr.

(57) ABSTRACT

A paper lifter with multiple lever arms and a loose-leaf ring binder combine to form a class two lever system. A row of apertures forms a pivot axis aligned with the rings of the binder. The lifter is slidably and pivotably connected to the binder through the apertures. The connection forms a first set of contact points between the lifter and the binder. An inside edge forms a second set of contact points with the rings. The two sets constitute a first lever system. A set of load arms reaches inward from the axis of the apertures to form a third set of slidable contact points with a protective plate of the binder ring mechanism. This third set and the first set combine to form a second lever system. Curvature of the load arm provides a variable length lever arm as a function of lifter angle with the protective plate. The lifter may comprise different segments; load arms and apertures may be on different segments of the lifter. The load arms may be inter-digitated in the space between the lifter apertures and binder rings. An effort arm extends outward and oppositely to reach and slide against the binder cover.

19 Claims, 4 Drawing Sheets

SEGMENTED PAPER LIFTER WITH MULTIPLE AND VARIABLE LENGTH LEVER ARMS

BACKGROUND OF THE INVENTION

1. Field of the Invention

This invention relates generally to the art of loose-leaf ring binders and particularly to paper lifters co-acting with binder rings to manage papers.

2. Prior Art

The prior art generally refers to ring binders, loose-leaf ring binders, rings or split rings, prongs, paper lifters, sheet lifters, paper inserts, punched papers, pre-punched sheet, and the like. It is understood that paper sheets and rings co-act. Thus, the spacing of punched holes and rings is a combination. The "rings" are in effect merely prongs that receive the punched papers or sheets, and may have many shapes. These range from true rings to straight bars or rods, to substantially rectangular prongs, and to paired combinations of rings and bars or other paired combination of shapes. The following usage of "rings" or "split rings" is not restricted to circular shapes, but will include any shapes and labels in general use.

Three rings, or sets of split rings, are the most common number and characteristics of rings in a given loose-leaf binder. This is a set that is generally duplicated in the number of holes in the paper inserts, punched papers, sheet, and paper lifters. However, two, five, and seven rings are common examples.

A typical paper lifter is a generally rectangular plate having apertures adapted to fit onto rings in a loose leaf ring binder. The apertures generally align with a transverse side of the lifter and generally provide a fulcrum for the lifter. This general lifter-binder combination presents a type two lever system.

Prior art portrays several sheet lifters. These lifters have in common a general lack of acceptance by the public; reasons include nonperformance, unwieldy to use, and expensive to produce. We will not repeat general reviews of the prior art found in the references. Specific attention will be directed to the following patents:

1. Lewis R. Beyer: "Sheet Lifter," U.S. Pat. No. 3,366,118, dated Jan. 30, 1968, hereinafter Beyer;
2. R. J. Kenkott: "Sheet Lifting Device for a Loose Leaf Binder," U.S. Pat. No. 2,276,987, dated Mar. 17, 1942, hereinafter Kenkott; and
3. J. B. Stuerke: "Fulcrum for Loose Leaf Binders," U.S. Pat. No. 2,505,694, dated Apr. 25, 1950, hereinafter Stuercke.
4. R. S. Mason: "Loose-Leaf Binder," U.S. Pat. No. 3,306, 301, hereinafter Mason.
5. I. Maudal: "Double Aperture Paper Lifter," U.S. Pat. No. 5,503,489, hereinafter Maudal.

The Beyer patent shows a standard ring binder with a protective plate over the ring mechanism. An elongated paper lifter inserts transversely over the rings through a plurality of apertures. An inner curved surface extends over the plate and ends in an uninterrupted edge; the curvature is sufficient to rotate the edge to lie flat against the inner circumference of each ring. The apertures and the edge are pressure points acting against the rings; they span an angular arc that is large enough to create components of force that move the lifter along the rings. Outward-sloping ribs are placed on top of the lifter and extend over and well beyond the apertures; their purpose is to slide binder papers away from the rings to prevent tearing of the papers. Ribs are also placed on the underside of the curved surface to prevent opposite pairs of lifters to interlock.

The Beyer patent places emphasis on obtaining sufficient spacing between the pressure points to move the lifter along the rings. The separation between the inner edge and the apertures is therefore determined while both pressure points are against the rings. When the lifter lies flat (ring binder open), the inner edge does not contact the protected plate but is instead suspended well above the plate. Only after rotating a considerable angle following first motion does the inner edge reach the plate. During this initial motion the lifter pivots about the apertures only; consequently, there is no motion of the lifter apertures along the rings. The apertures therefore catch and tear the papers in the binder. The invention inserts outward-sloping ribs to solve this problem, thus causing additional complexity.

Kencott also shows a standard ring binder with a protective plate and lifter apertures engaged with the rings. The load end curls upward over the plate and then closes upon itself to form a closed rocker with an upper shelf. The end of the shelf has a small semicircular notch that abuts the ring. In operation the lifter leverages on the curved rocker portion and rides up the ring on the notch in the shelf end; the shelf pushes the paper sheets.

The rockers must be large to provide a high enough step to raise the paper sheets sufficiently. Thus the rockers become large enough to abut each other when installed as opposing pairs in the ring binder; yet they may not be large enough to fully raise the paper sheets. However, the suspected deficiency is neatly avoided by claiming beneficial co-action between the opposing lifters.

The Stuercke patent shows improvements upon the Kencott invention. One improvement consists of a raised surface mounted on top of the protected plate. This surface serves as an artificial protective plate and raises the height of the lifter. A second improvement is a guide that engages the closed rocker and limits unwanted movements of the lifter. These improvements expressly confirm the reservations noted above about the Kencott invention; yet solves the problem. The result, however, is a cumbersome addition to a prior device.

The Mason patent is included to show a type one lever system. The system includes a channel fastened to the binder book back. A single flat sheet is hinged to the flange edges; the hinge establishes a fulcrum. Apertures provide room for accommodating the rings of the binder. The apertures are only clearance holes, however, and do not provide an additional fulcrum for the lifter.

The Maudal patent is included as a significant prior art. This patent, however, shows a type two lever system where all lever arms are in line with the rings of the binder. They also feature slots for avoiding load arm entanglements with the rings.

SUMMARY OF THE INVENTION

This invention builds on the realization that the general lose-leaf ring binder presents several different abutment interfaces to a paper lifter. The rings emanating from a ring mechanism provide a first interface, a protective plate over the ring mechanism provides a second interface, and the binder covers provide a third interface.

The lifter provides corresponding interfaces in a set of contact points. Lifter apertures adapt to receive the split rings form a first set of contact points lying on a pivot axis. The inner edge of the lifter provides a second contact point. Load arms, extending from the pivot axis inward over the protective plate, provide a third contact point. The outer edge of the lifter provides a fourth contact point.

A central point of interaction between the binder and the lifter comprises contact points of the binder rings and lifter apertures. This forms a slidable pivot axis for the lifter and a fulcrum for a lever system. Useful lifter performance is now available by establishing favorable moment arms operating about this fulcrum.

It should be noted that a moment arm refers to a physical embodiment of a function, i.e., the physical span between two points results in a functional lever system. "A moment arm" may comprise a plurality of physical elements with pluralities of physical contact points.

A first moment arm, a load arm, spans the pivot axis and the load arm contact point. Design of the load arm and a load arm surface establishes a positive contact with the protective plate throughout most of the lifter pivoting operation. Additionally, the load arm comprises a continuously increasing arm length as a function of lifter angle. This function is facilitated by the rings and by a generally curved load arm surface. A second moment arm, an inner arm, spans the pivot axis and the inner edge of the lifter. A third moment arm, an effort arm, spans the pivot axis and the outer edge of the lifter.

Offset moment arms and contact points comprise a central feature of this invention. Thus, the contact points of the load arms are offset from the binder rings and lifter apertures. The offset avoid interference by the ring during critical stages of binder operation.

Staggered and offset pivot planes provide an additional central feature. The load arms in a symmetrical offset pattern must be limited in length to avoid entanglement with the load arms of the opposing lifter pair. When asymmetrically staggered, however, the load arms may safely extend further to improve moment arm efficiency.

A segmented design of the lifter comprises a further central feature of the preferred embodiment. Several individual segments may support diverse lifter functions One segment may provide support for co-action between the lifter apertures and the split rings; a second segment may provide support for load arms and contact surfaces, and a third segment may provide support for an effort arm.

Adaptation of the lifter operation to encompass two sizes of pivot rings is also a feature of this invention. A design difficulty arises in this regard because an optimum load arm for the larger ring system would be too long for the smaller ring system. We instead design the smaller ring first and allow the load arm to remain in contact with the cover plate throughout the rotation of the lifter. For a larger diameter ring we rely on the small load arm to provide positive contact during a first phase of closing. However, in a second phase we transfer contact between load arm and protective plate to contact between the inner edge and the inside of the rings. The inner arm now provides the necessary moments and forces.

A description of lifter embodiments adapted to functional requirements is apparent by considering the operation of the lifter during the closing of the binder. Throughout the process the lifter will pivot about the pivot axis and simultaneously slide outward along the binder rings and the protective plate to move the loose leaf papers. The outward motion increases the length of the load arms. We consider the operation with both size rings to illustrate the two closing phases.

An open binder lies initially upon on a flat surface, thus the lifter lies parallel to the flat surface, to the protective plate, and to the open binder covers. The apertures thread the rings and lie over the ring exit holes, the effort arm extends over the binder cover, the load arm extends over the protective plate, and the contact surfaces are in positive contact with the protective cover.

We commence closing the binder with the inner contact point of the load arm in positive contact with the protective plate. An effort force at the contact with the binder cover and the reflected force at the contact points with the protective plate are both normal to the lifter. The resulting force developing at the load points near the apertures is also normal. Because the ring exit angle at the exit holes is large, the component of the force acting tangentially to the rings is significant. The tangential component thus slides the lifter, and binder papers, easily along the ring while pivoting about the load arm contact point with the protective plate. This initial efficiency relies on the positive contact of the load arm with the protective plate.

As the closing motion continues the lifter rotates with respect to the protective plate. As this angle increases, a smaller and smaller component of the effort force will be tangential to the rings. However, because the load arm is pushing against the plate, a larger and larger component of the load force will align itself with the lifter load arm. This force is pushing tangentially to the rings and compels the lifter load point to slide up the rings. This tangential force is a significant part of the efficient operation of the lifter. The phase characterizes the closing of a binder with the smaller diameter rings.

During closing with the larger diameter rings the load arm contact points with the protective plate slides outward toward the rings emerging through the exit holes. At this point the lifter contact points transfer from the load arms to the inner edge of the lifter. The advantage of the pushing force along the load arm is lost. Instead, the tangential forces now depend on the moments provided by the inner arm. This characterizes the last phase of operation with a binder with larger rings.

This invention presents the favorable force separation of the load arm from interference by the binder rings. This is achieved by inter-digitating the load arms with respect to the rings. The inter-digitation is enhanced by a segmented lifter design. The lever arm between the lifter load arm contact points and the contact points of the apertures affords the necessary lifting force to move the binder papers during the initial rotation of the lifter.

As a result, the preferred lifter embodiment of this invention operates in two phases. Lifter contact points slides against the protective plate in the first phase. In the second phase the split rings and inner edge of the lifter provide the leverage for the lifter.

OBJECTS OF THE INVENTION

It is a principal object of this invention is to obtain an improved paper lifter in a loose-leaf ring binder that will easily move the loose-leaf papers without binding or tearing the papers.

It is also a principal object of this invention to obtain a lifter that operates with a large moment arm to facilitate forceful movement of loose-leaf papers in a loose-leaf note book.

It is a further object of this invention to prevent interference by the binder rings in the operation of the lifter.

It is another principal object of this invention to manage loose-leaf sheets of papers in a binder even when the binder is jammed full of paper sheets.

DETAILED DESCRIPTION OF PREFERRED EMBODIMENTS

Figure 1:
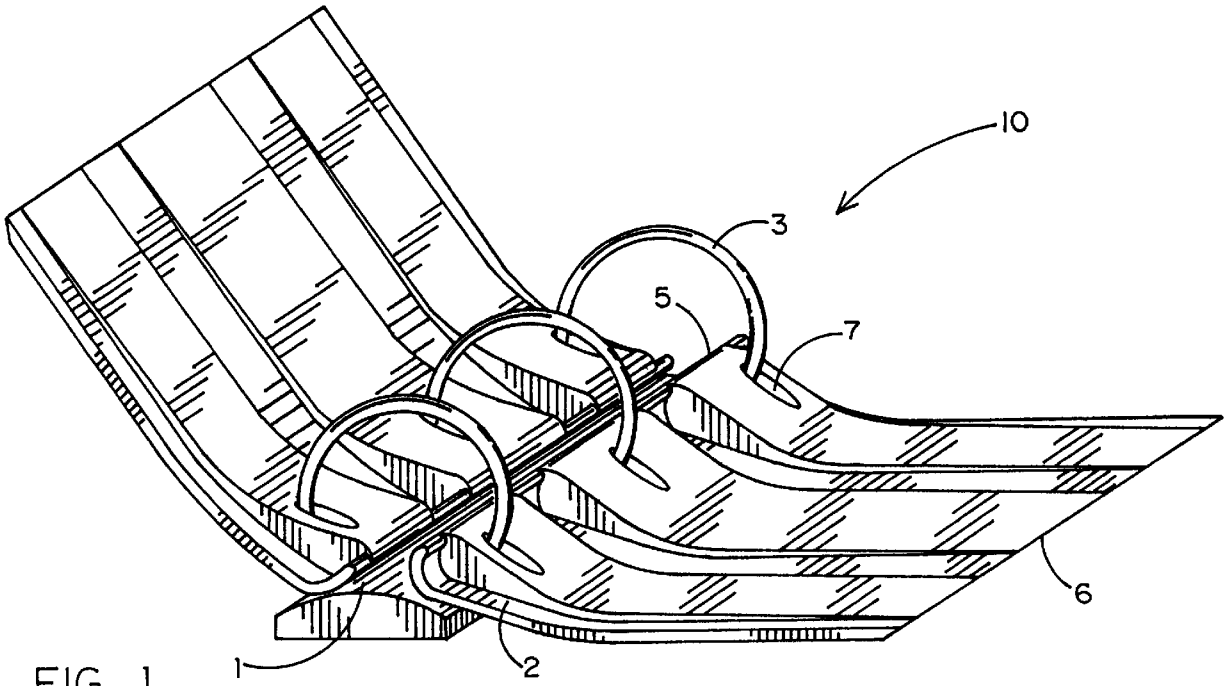
FIG. 1 is a perspective view of a lever system formed by the preferred embodiment of the invention and the rings of a loose leaf binder.

FIG. 1 shows a preferred embodiment of this invention designated by the numeral 10. There is shown a general combination of split rings 3 of a loose leaf binder, a protective shield 1 over ring mechanisms, and paper lifters 4 of this invention. The rings 3 and the protective plate 1 are parts of a typical ring binder. The protective plate 1 fastens to a book back of a binder. The rings 3 exit from the binder protective plate 1 through two rows of exit holes 2 running parallel to the outside edges of plate 1. The ring mechanism, binder back, and covers are not shown.

FIG. 1 further shows a generally rectangular paper lifter 4 with inner edge 5 and outer edge 6 forming the transverse sides of the lifter. The lifters conform substantially to the length of the protective plate 1. The lifter may be formed from a generally flat blank of pressed paper that may then be fashioned to desired shapes; it may also be formed from plastic materials via injection molding processes or any other materials and processes of the art. A row of guide holes 7 run the length of each lifter 4 and are placed a distance from the inner edge 5. The lifter width extends outward from the guide holes 6 to substantially reach out over the binder cover to outer edge 6; the width reaches inward to substantially reach over the protective plate 1 to the inner edge 5.

Figure 2:
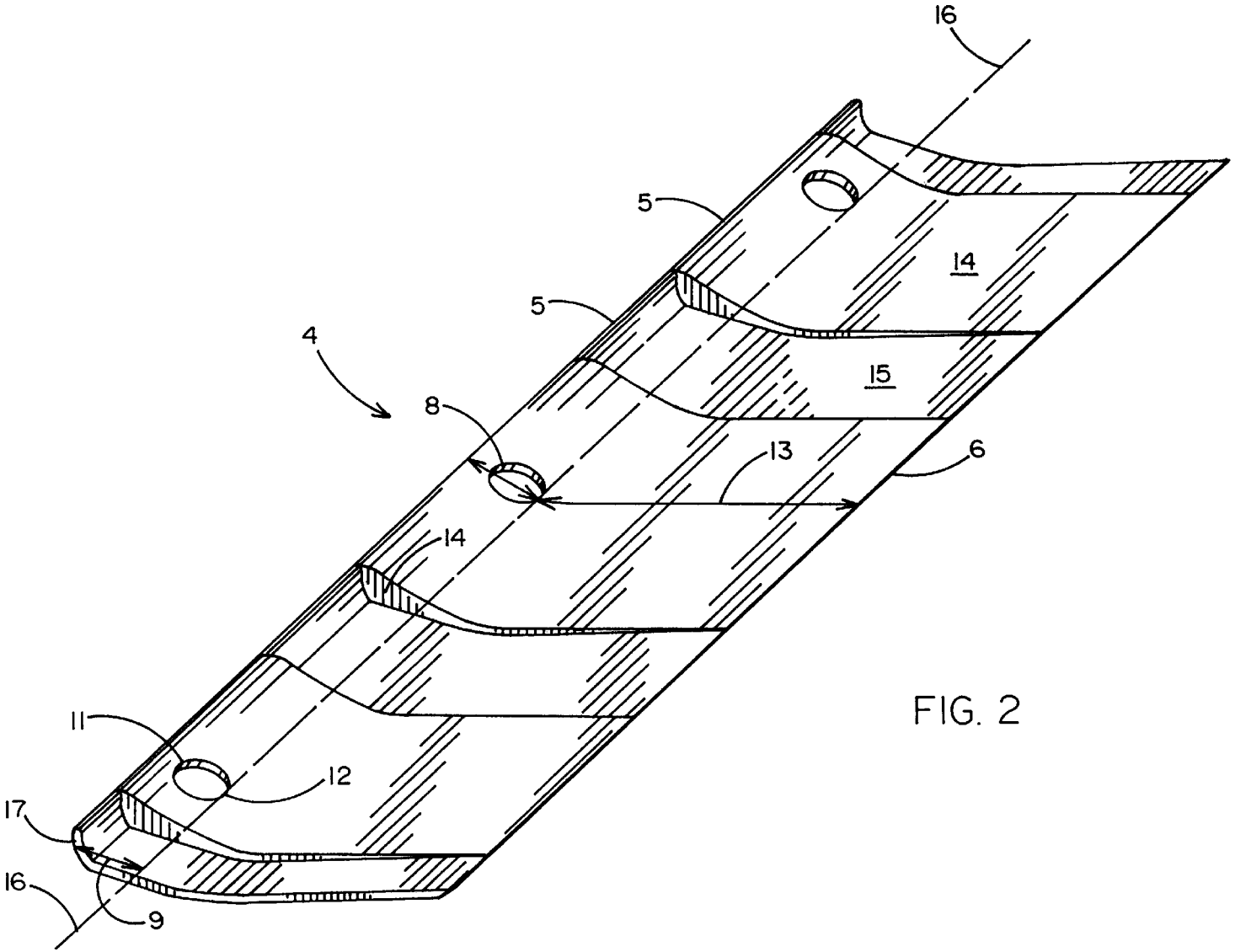
FIG. 2 is a perspective view of a preferred embodiment of the segmented lifter.

FIG. 2 depicts a segmented lifter 4. Three support segments 14 and four load segments 15 emanate from a generally common outer edge 6. The support segments 14 center substantially on the guide holes 7 and pivotably and slidably support the lifter on the split rings 3. There are generally as many support segments as there are rings. The support segments 14 end on a generally common inner edge 5. The guide holes 7 have inner rims 11 and outer rims 12. A line touching outer rims 12 of the guide holes 7 forms pivot axis 16. The distance between the pivot axis 16 and the inner edge 5 on support segment 14 forms inner arm 8. The distance between the pivot axis 16 and the outer edge 6 form effort arm 13.

The load segments 15 are generally offset from the support segments 14 to avoid entanglements with split rings 3. In this preferred embodiment the load segments 15 fits between the support segments 14; a remaining two load segments 15 are appended to the outside of the lifter 4. The load segments 15 emanate from generally common outer edge 6, transition to load surfaces 17, and end in generally common inner edge 5. The distance from the pivot axis 16 and the load surfaces 17 is load arm 9.

Figure 3:
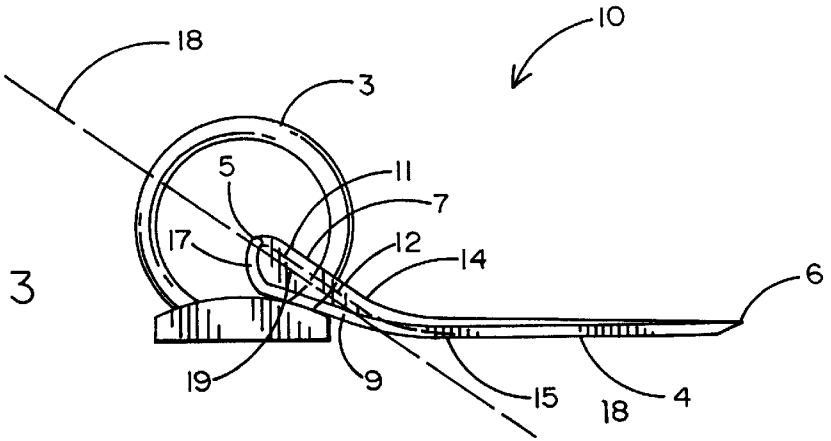
FIG. 3 is a side view of the lever system formed by the segmented lifter of the invention and the rings in a loose leaf binder.

FIG. 3 is an end view of the system 10 with the binder open and with lifter 4 flat against the binder covers (not shown). Shown are end views of the splits rings 3, the lifter 4, inner edge 5, outer edge 6, the support segment 14, and the load segment 15. The ends of segments 14 and 15 curve upwards toward the outer edge 6 to smooth the interface with the binder covers (not shown). Reference line 18 angles downward substantially 30 degrees from the inner edge 5. FIG. 3 illustrates the lifter in a smaller diameter ring binder.

The support segments 14 begin at the outer edge 6 and generally rise from a level reference until substantially reaching reference line 18. From thence it curves upward and parallels reference line 18 toward the inner edge 5. The angle of the support segments 14 with respect to the reference line 18 is established substantially around the guide holes 7 to facilitate the angle traversed during pivoting operation.

The load segments 15 extend generally below support segment 14. After crossing the reference line 18 the load segments 15 reaches substantially out over the protective plate 1 with load arm 9. Substantially over the plate 1 the load segments 15 angles up sharply to formed curved load surfaces 17. The curved load surfaces 17 end on the generally common inner edge 5. The curvature of load surfaces 17 is contoured to maintain an ever increasing load arm 9 between the pivot axis 16 and the load surfaces 17 contact points with the protective plate 1. The load surfaces 17 therefore comprise loci of the increasing load arm 9 as a function of the angle of lifter 4. The effect is to propel the guide holes 7 up the split rings 3 as the lifter 4 rotates about the pivot axis 16. (Shown in FIG. 4).

Avoiding lifter hang-up upon opening of the binder covers places a limitation on the angular relationship between load surfaces 17 and the plate 1 near the inner edge 5. A critical angle here is defined by a plane tangential to the load surfaces 17 at the point of contact with the plate 1. This angle between the tangent plane and the plate 1 must be less than 90 degrees; otherwise the lifter will fail to regain a level position and will hang up upon opening of the binder.

The boundaries of the diverse segments form structural ribs 19. These are maintained generally normal to the segment surfaces to stiffen the lifter 4. The number of segments my be increased in order to increase lifter stiffness.

The lifter operation upon closure of the binder delineates the relationship between segments, shows the moment arms facilitating operation, and illustrates the process of developing the shape of curved load surfaces 17. The beginning of the operation is shown in FIG. 3. The intersections of load segments 15 and load surfaces 17 contact the protective plate 1 of the binder. A force applied to the outer edge 6 by the binder covers and the resulting reaction force at the contact points of curved load surfaces 17 with plate 1 combine to act on the lifter at the pivot axis 16, i.e., outer rims 12 of the guide holes 7. The tangential component of the combined force acts at the split rings 3 and begins to move the lifter, and loose-leaf papers (not shown), up the rings.

Figure 4A:
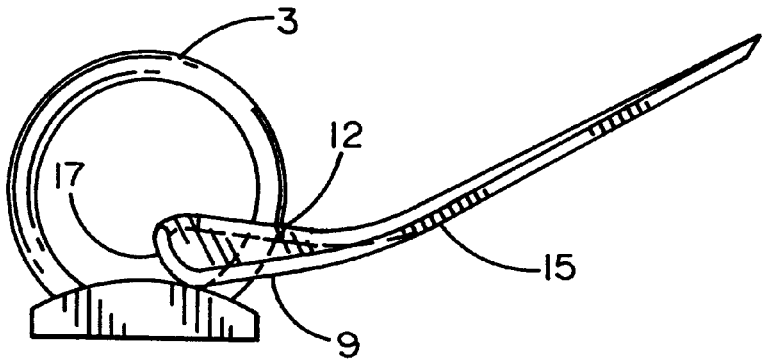
FIG. 4 is side views of a sequence of lifter positions during closing operation in a binder with smaller diameter rings.
Figure 4B:
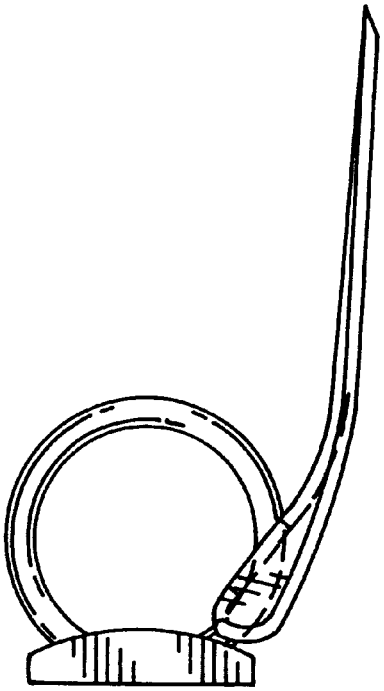

FIG. 4 illustrates the operation with the smaller diameter rings. FIG. 4(*a*) depicts the lifter raised approximately 30 degrees. The contact points between the split rings 3 and the pivot axis 16, and outer rims 12 of guide holes 7, have moved out and up the split rings 3. The contact points between the lifter load surfaces 17 and the binder protective plate 1 must necessarily follow, by virtue of a connection via the load arm 9 to the pivot axis 16, by sliding across the plate 1 to its present position. Note that the contact points have moved into the load surfaces 17 by virtue of the rotation of the lifter.

The force applied to the outer edge 6 is again resolved into a component acting tangentially to the split rings 3 at the pivot axis 16. However, the reactive force acting on the load surfaces 17 is resolved into a component along the load arm 9. This force acts substantially at a tangent to the split rings 3 at the pivot axis 16 at outer rims 12. This force is therefore highly effective and enhances the resulting lifter operation. FIG. 4(*b*) illustrate continued contact with the plate 1 after lifter rotation of 90 degrees.

Figure 5A:
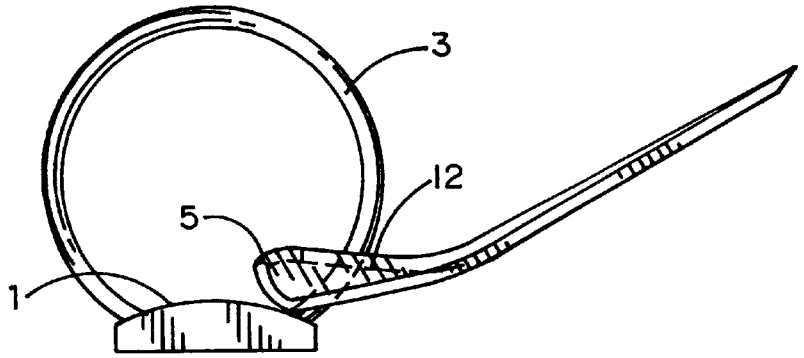
FIG. 5 is side views of a sequence of lifter positions during closing operation in a binder with larger diameter rings.
Figure 5B:
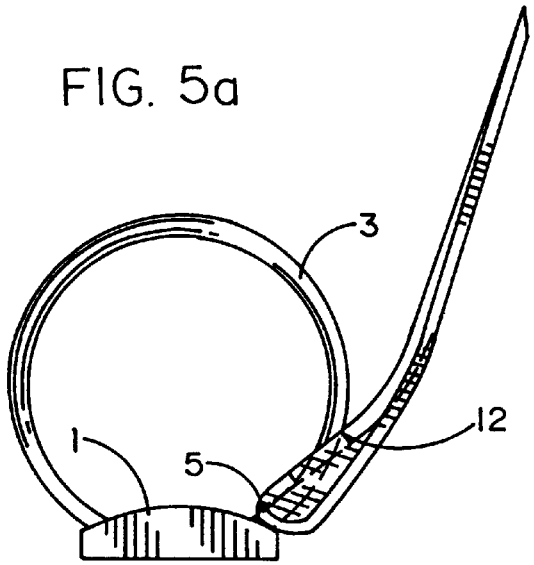
Figure 5C:
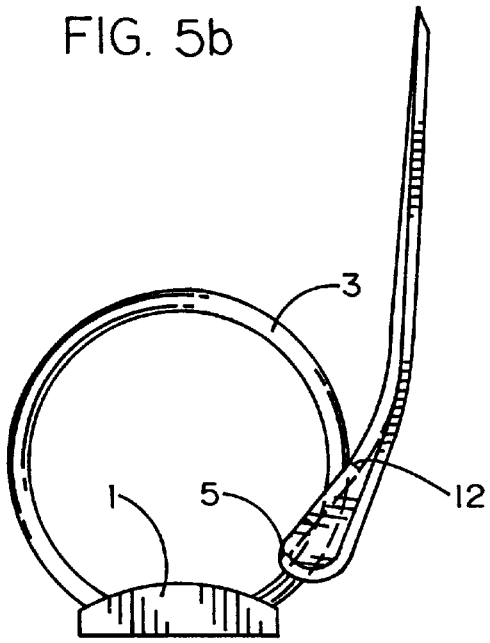

FIG. 5 illustrates the lifter operation with the larger diameter rings. FIG. 5(*a*) depicts the lifter rotated approximately 30 degrees. This rotation places the lifter connection with plate 1 at the beginning of load surfaces 17. The operation is similar to that of the smaller rings shown in FIG. 4. FIG. 5 (*b*) shows the rotation approximately 70 degrees. This rotation represents the last contact with the plate 1 by the load surfaces 17. Further rotation will bring the inner edge 5 against the split rings 3 and change the contact points from the load surfaces 17 to the inner edge 5. The active lever arm now becomes the inner arm 8. Similar forces will again force the pivot axis 16 to slide up the split rings 3.

FIG. 5(*c*) shows further continuation of the operation and depicts the lifter rotated approximately 90 degrees. Contact between the plate 1 and the load surfaces 17 are broken and the lever system depends exclusively on the inner arm 8. This is less efficient. However, it is deemed sufficient since the forces required at this point are smaller.

Thus, there has been provided, according to the invention, an improved paper lifter that is economical to use. It is to be understood that all the terms used herein are descriptive rather than limiting. Although the invention has been described with the specific embodiments set forth above, many alternative embodiments, modifications and variations will be apparent to those skilled in the art in light of the disclosure set forth herein. Accordingly, it is intended to include all such alternative embodiments, modifications and variations that fall within the spirit and scope of the invention as set forth in the claims hereinbelow.

What is claimed is:

1. An improved paper lifter co-acting with a ring binder having binder covers with a spline therebetween, a plurality of split rings emerging from a protective cover over a ring mechanism mounted on the binder, the paper lifter slidably and pivotally connected to the rings via apertures receiving the rings, the apertures having inside rims which form slidable and pivotal contact points with the rings, the contact points delineating a lifter pivot axis serving as a fulcrum for lifter moment arms, one such moment arm being an effort arm extending crosswise from the lifter pivot axis outward over the binder cover to an outer edge of the lifter and to outer contact points with the cover, the improvements comprising:

a multiplicity of interconnected load arms of mixed lengths, the load arms forming a plurality of sets of like load arms, and the load arms of each set extending from the pivot axis inward and across the lifter toward corresponding sets of inner edges of the lifter, the inner edges adapted to abut different sets of predetermined binder contact surfaces; whereby the sets of load arms slidably reaching and pivotally leveraging against the different sets of binder contacts surfaces.

2. The paper lifter of claim 1 further comprising:

a first set of load arms extending a first length from the pivot axis to an first inner edge of the lifter, the first inner edge adapted to slidably and pivotally leverage against inside surfaces of the rings, the inner edges forming contact points substantially removed from the pivot axis; and at least one additional set of surface load arms extending inward a second length from the pivot axis to a surface set of second leverage surfaces, the second leverage surfaces adapted to abut a set of binder surfaces.

3. The paper lifter of claim 2 wherein:

the surface load arms are offset from the planes of the rings of the binder, whereby the one additional set of load arms avoids entanglements with the rings.

4. The paper lifter of claim 3 wherein:

at least one load arm of the surface set is placed outside the outer rings of the binder.

5. The paper lifter of claim 1 wherein:

the surface load arms are adapted in lengths to reach the binder spline.

6. The paper lifter of claim 1 wherein:

the surface load arms are adapted in length to reach the binder covers.

7. The paper lifter of claim 1 wherein:

the surface load arms are adapted to reach the protective cover.

8. An improved paper lifter connected slidably and pivotally to rings of a ring binder, the improvements comprising:

a multiplicity of support segments distributed along an elongated side of the lifter;

aperture segments of the support segments having apertures adapted to receive the rings, the connection between the lifter apertures and the binder rings forming contact points along a pivot axis, the aperture segments interconnectedly interspersed between the support segments, the aperture segments forming an aperture set;

a multiplicity of different load arms affixed to corresponding support segments, the load arms extending from the pivot axis inward toward alternate contact points with the binder, the alternate contact points between lifter and binder substantially removed from the pivot axis; and a plurality of load arm sets comprising support segments of like load arms.

9. The improved paper lifter of claim 8 further comprising:

a set of aperture load arms affixed to the aperture segments, the aperture load arms extending inward from the pivot axis to inner aperture edges of the lifter substantially removed from the pivot axis.

10. The improved paper lifter of claim 1 including load arms of mixed shapes.

11. The improved paper lifter of claim 9 wherein at least one set load arms are off-set from planes formed by the rings in the ring binder.

12. The paper lifter of claim 11 wherein the segments of the at least one set of load arms is offset a-symmetrically.

13. The paper lifter of claim 12 wherein the load arms of the at least one set of the surface segments alternately extend substantially beyond the center line of the rings, thereby achieving greater lifter leverage while avoiding entanglements with opposite companion lifters.

14. The paper lifter of claim 8 wherein at least one of the load arms is connected outside the outer rings of the binder.

15. The improved paper lifter of claim 9 wherein the inner aperture edges are adapted to slidably and pivotally abut the inside of the binder rings.

16. An improved paper lifter co-acting with a ring binder having binder covers with a spline therebetween, a plurality of split rings emerging from a protective cover over a ring mechanism mounted on the binder, the improvements comprising:

a support segment having apertures along an elongated side of the lifter, the apertures slidably and pivotally connecting the lifter to the rings along a pivot axis;

a plurality of sets of inner lifter edges adapted to form slidable and pivotal contact points between the inner lifter edges and predetermined alternate binder surfaces, the surfaces generally near the center of the rings; and means for affixing the inner edges to the support segment, the means forming sets of load arms of different lengths between the pivot axis and sets of like inner lifter edges.

17. The improved paper lifter of claim 16 where a first set of inner edges are adapted to contact the inside of the binder rings.

18. The improved lifter of claim 17 where a second set of inner edges slidably abuts the binder cover.

19. The improved lifter of claim 18 where the second set of inner edges abuts the binder spline.

* * * * *